US005970520A

United States Patent [19]

Garofalo

[11] Patent Number: 5,970,520

[45] Date of Patent: Oct. 26, 1999

[54] BALANCING JACKET

[75] Inventor: Giovanni Garofalo, Rapallo, Italy

[73] Assignee: HTM Sport S.p.A., Italy

[21] Appl. No.: 09/133,806

[22] Filed: Aug. 13, 1998

[30] Foreign Application Priority Data

Sep. 12, 1997 [IT] Italy ..... GE970032 U

[51] Int. Cl.[6] ..... A41D 13/00

[52] U.S. Cl. ..... 2/102; 2/2.15; 2/468

[58] Field of Search ..... 2/2.15, 2.16, 462, 2/463, 467, 102, 468, 456, 465, 94, 108

[56] References Cited

U.S. PATENT DOCUMENTS

| | | | |
|---|---|---|---|
| 3,135,098 | 6/1964 | Root | 61/70 |
| 3,396,406 | 8/1968 | Gongwer | 2/2.15 |
| 3,855,631 | 12/1974 | Ettinger | 2/468 |
| 4,590,622 | 5/1986 | Wolfe et al. | 2/468 |
| 4,791,921 | 12/1988 | Robison | 2/2.15 |
| 4,821,339 | 4/1989 | Fair | 2/462 |
| 4,982,447 | 1/1991 | Henson | 2/462 |
| 5,159,716 | 11/1992 | Takata | 2/2.16 |
| 5,516,234 | 5/1996 | Duchesne | 2/102 |
| 5,701,611 | 12/1997 | Rector et al. | 2/462 |

*Primary Examiner*—Amy Vanatta
*Attorney, Agent, or Firm*—Larson & Taylor

[57] ABSTRACT

A balancing jacket for scuba divers is in the form of a sleeve-less waist-length jacket made from strong, heavy materials worn over a diving suit made from neoprene. Pads made from a soft plastics material are placed in the armholes and in the neck area of the jacket. The jacket further includes a soft back covered with an elastomeric material with a high coefficient of friction on neoprene.

5 Claims, 1 Drawing Sheet

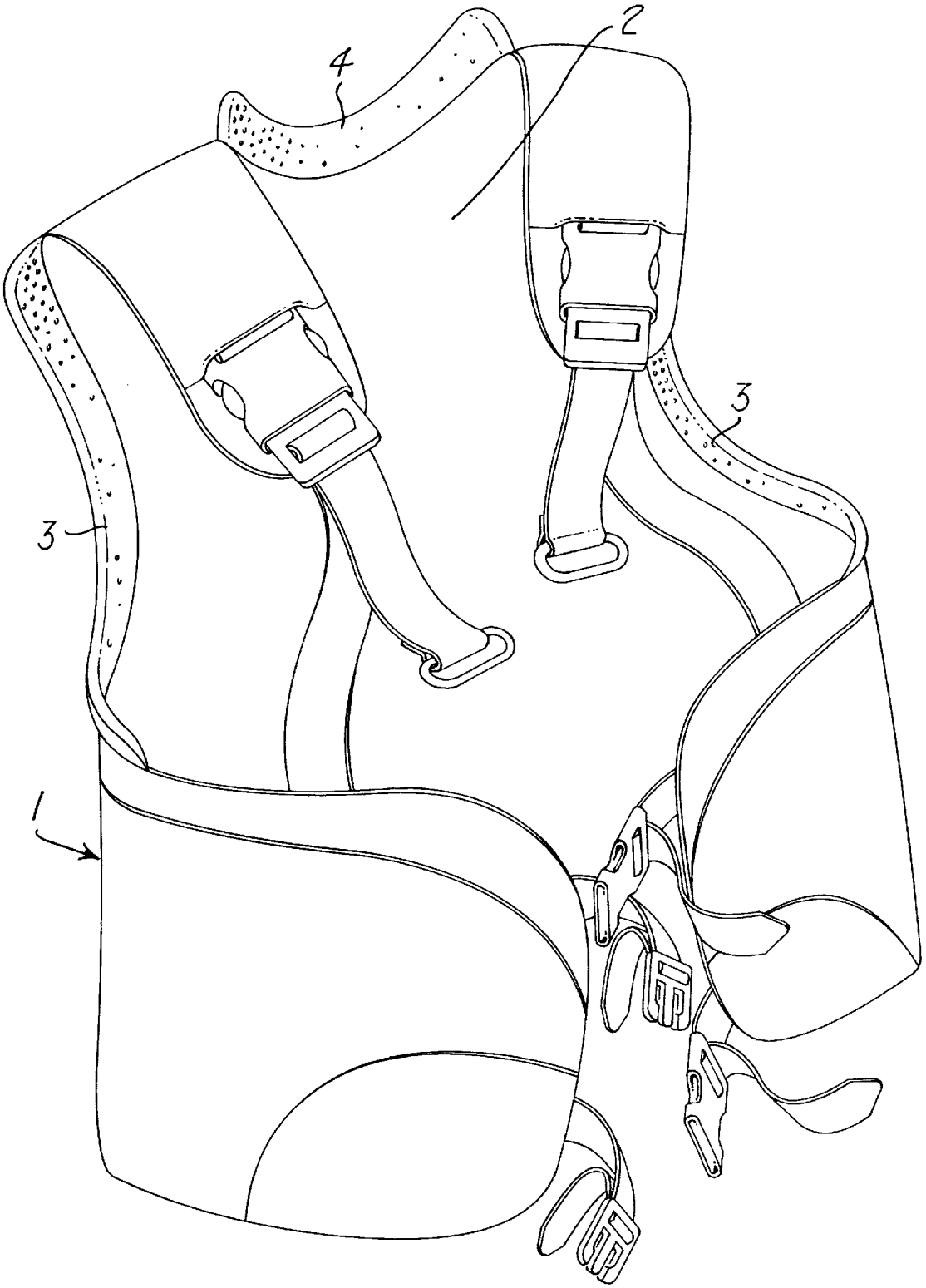
2
4
3
3
1

BALANCING JACKET

BACKGROUND OF THE INVENTION

The present invention relates to a balancing jacket to which some improvements have been made.

Balancing jackets are now manufactured in several models differing from each other: from those with total air circulation to handier models with quick releasing systems.

The said balancing jackets are generally made from strong, heavy materials such as a tissue of polyamidic fibers (like the one known by the trade name of "NYLON") laminated with multi-layer polyurethane.

Bottles, the weight of which can reach or even go above 30 kg, are secured on the balancing jacket which is normally worn over a wet suit. During diving, such weight not only weighs on the diver, but because of the inertia, the bottles may move slightly on the diver's back, therefore, there will also be a movement of the jacket on the wet suit clinging to the body. Because of such movement, the jacket rubs against the neck and around the armhole which can cause some irritations, or even slight abrasions in such delicate body areas.

SUMMARY OF THE INVENTION

The present invention aims at eliminating such disadvantages.

In order to achieve this result a balancing jacket has been created, said jacket having its back covered with such a material that its coefficient of friction is very high towards the wet suit material. In this way a higher stability on the user's back is achieved, and, moreover, the areas around the neck and the armhole have been padded so as to ensure a greater comfort.

BRIEF DESCRIPTION OF THE DRAWINGS

The invention will now be described with more details with reference to the enclosed drawing, the single FIGURE of which is a perspective frontal view of a balancing jacket according to the invention.

DESCRIPTION OF THE PREFERRED EMBODIMENT OF THE INVENTION

With reference to the drawing, the jacket 1 is a generic hydrostatic balancing jacket which is worn onto the wet suit.

Though they can't be seen, the means to fix the bottles are present in the back part. As is evident, the bottles can move from the user's body during diving. And since, as said before, the bottles are connected to the jacket, they drag the latter in their movement.

The padded back 2 is covered with a special elastomeric material with a high softness which is obtained, for instance, by means of a high quantity of plasticizer and of a high coefficient of friction towards the neoprene of the wet suit. In such a way the movements of the balancing jacket, and therefore of the bottles, are eliminated or at least highly limited.

If, in spite of the special back 2, there should still be some slight movements of the jacket 1, the latter, according to a form of embodiment of the invention, is provided with pads 3 in the armhole area. The soft pad eliminates irritations in the delicate armpit area of the user, such irritations being caused by the jacket rubbing against the wet suit.

The collar 4 is also padded, thus avoiding any bothersome irritations on the neck due not only to small movements of the jacket, but also because of the weight of the bottles.

The pads 3 and 4 can be covered with the same material used for the back 2, so as to ensure a higher stability in these areas as well.

I claim:

1. A balancing jacket for use over a scuba diving suit, said jacket comprising a sleeve-less jacket comprising a strong, heavy material including pads comprising a soft plastics material located in armhole and neck areas of the jacket for eliminating irritations caused by the jacket rubbing against the diving suit.

2. Balancing jacket according to claim 1, wherein a back of said jacket further includes a covering comprising an elastomeric material having a high coefficient of friction on neoprene.

3. Balancing jacket according to claim 2, wherein said pads located on the armholes and the neck areas of the jacket include a covering of the elastomeric material covering the back of the jacket.

4. Balancing jacket according to claim 3, wherein the elastomeric material contains a high quantity of plasticizer.

5. Balancing jacket according to claim 1 wherein said strong, heavy material comprises a tissue of polyamidic fibers laminated with multi-layer polyurethane.

* * * * *